US009261060B2

(12) United States Patent
Straub

(10) Patent No.: US 9,261,060 B2
(45) Date of Patent: Feb. 16, 2016

(54) FUEL INJECTOR WITH VARIABLE AREA POPPET NOZZLE

(75) Inventor: Robert D. Straub, Lowell, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 981 days.

(21) Appl. No.: 12/752,282

(22) Filed: Apr. 1, 2010

(65) Prior Publication Data

US 2011/0239991 A1 Oct. 6, 2011

(51) Int. Cl.

| | |
|---|---|
| ***F02M 39/00*** | (2006.01) |
| ***F02M 61/18*** | (2006.01) |
| ***F02M 61/12*** | (2006.01) |
| ***F02M 61/08*** | (2006.01) |
| ***F02M 61/10*** | (2006.01) |
| *F02M 51/06* | (2006.01) |
| *F02M 63/00* | (2006.01) |
| *F02M 47/02* | (2006.01) |

(52) U.S. Cl.

CPC ..... *F02M 51/0603* (2013.01); *F02M 61/08* (2013.01); *F02M 61/10* (2013.01); *F02M 61/12* (2013.01); *F02M 61/1886* (2013.01); *F02M 61/1893* (2013.01); *F02M 47/027* (2013.01); *F02M 51/061* (2013.01); *F02M 63/0026* (2013.01); *F02M 2200/46* (2013.01); *F02M 2200/701* (2013.01); *F02M 2200/8038* (2013.01); *F02M 2200/8061* (2013.01)

(58) Field of Classification Search

CPC . F02M 47/027; F02M 61/12; F02M 63/0026; F02M 61/1893; F02M 2200/8038; F02M 2200/8061

USPC ..... 239/533.2, 533.8, 533.9, 533.3, 533.7, 239/585.1–585.2, 88–93, 533.4, 96, 584, 239/124, 125, 102.1, 102.02

See application file for complete search history.

(56) References Cited

U.S. PATENT DOCUMENTS

| | | | | |
|---|---|---|---|---|
| 4,046,322 | A | 9/1977 | Knape et al. | |
| 4,082,224 | A * | 4/1978 | Mangus | 239/453 |
| 4,693,424 | A | 9/1987 | Sczomak | |
| 5,522,550 | A | 6/1996 | Potz et al. | |
| 5,671,890 | A | 9/1997 | Cooper et al. | |
| 5,823,443 | A | 10/1998 | Cooper et al. | |
| 6,079,641 | A * | 6/2000 | Shinogle | F02M 45/04 239/533.4 |
| 6,311,950 | B1 * | 11/2001 | Kappel | F02M 51/0603 251/129.06 |

(Continued)

FOREIGN PATENT DOCUMENTS

KR 1020090107603 A 10/2009

*Primary Examiner* — Len Tran
*Assistant Examiner* — Joel Zhou
(74) *Attorney, Agent, or Firm* — Harness, Dickey & Pierce, P.L.C.

(57) ABSTRACT

A fuel injector may include a housing, a poppet valve assembly, and an actuation assembly. The housing may define a longitudinal bore, a high pressure fuel duct in communication with the longitudinal bore and a valve seat including a valve seat surface and an aperture. The poppet valve assembly may include a stem and a valve head, be disposed within the longitudinal bore and be variably displaceable between a first position and a second position. In the first position, the valve head may abut the valve seat to seal the aperture. In the second position, the valve head may be displaced from the valve seat to open the aperture. The actuation assembly may operate to move the poppet valve assembly between the first position and the second position. The high pressure fuel duct may carry pressurized fuel that biases the poppet valve assembly to be in the first position.

14 Claims, 6 Drawing Sheets

(56) References Cited

U.S. PATENT DOCUMENTS 6,592,050 B2 * 7/2003 Boecking ..... F02M 47/027 239/533.2
6,824,081 B2 * 11/2004 Peters ..... F02M 47/025 239/533.2
2001/0038043 A1 * 11/2001 Popp ..... F02M 47/046 239/584
2003/0201344 A1 * 10/2003 Wark ..... 239/533.8
2005/0017096 A1 * 1/2005 Bachmaier ..... F02M 51/0603 239/584
2008/0210773 A1 * 9/2008 Malek ..... F02M 45/10 239/102.2

* cited by examiner

FIG 5
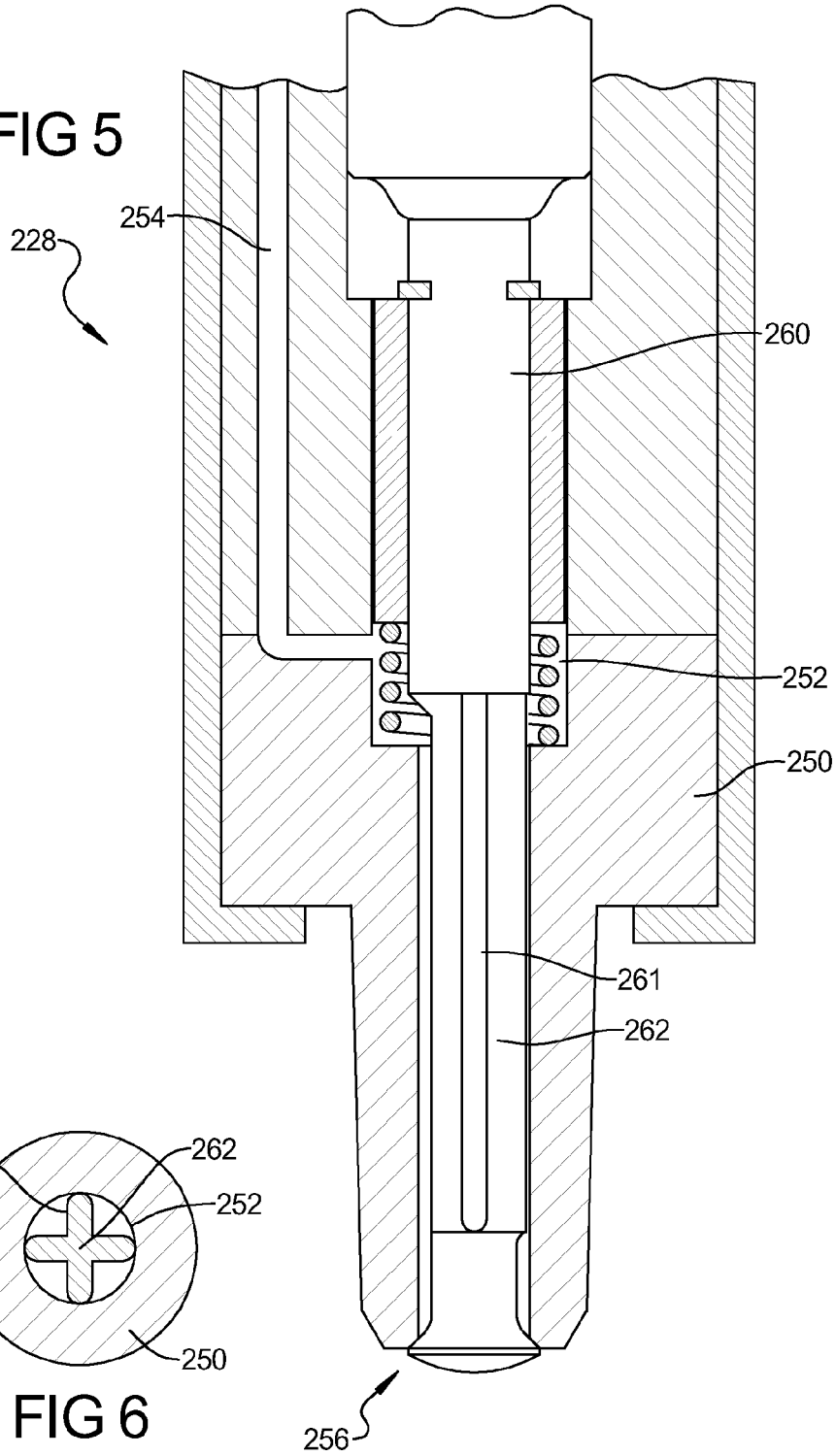
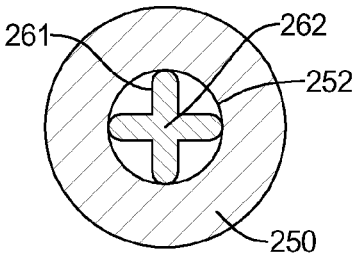
FIG 6

FUEL INJECTOR WITH VARIABLE AREA POPPET NOZZLE

FIELD

The present disclosure relates to engine fuel systems, and more specifically to fuel injectors.

BACKGROUND

This section provides background information related to the present disclosure which is not necessarily prior art.

A fuel injector may include a pressurized fuel supply used to open and close an injection nozzle opening. The injector may include an actuation member and a valve mechanism to selectively open and close a leakage path between low pressure and high pressure regions of the injector. Opening the leakage path may reduce a closing biasing force applied to an injection valve to open the injection nozzle opening. When the leakage path is closed, the injection valve may be displaced to close the injection nozzle opening. Thus, the injection nozzle opening is typically in one of two positions, i.e., a closed position or an open position, depending on whether pressurized fuel is being provided to the injection nozzle opening.

SUMMARY

This section provides a general summary of the disclosure, and is not a comprehensive disclosure of its full scope or all of its features.

A fuel injector may include a housing, a poppet valve assembly, and an actuation assembly. The housing may define a longitudinal bore, a high pressure fuel duct in communication with the longitudinal bore and a valve seat including a valve seat surface and an aperture. The valve seat surface may be in communication with the high pressure fuel duct. The aperture may extend through the valve seat surface and be in communication with the longitudinal bore. The high pressure fuel duct may carry pressurized fuel. The poppet valve assembly may include a stem and a valve head. The poppet valve assembly may be disposed within the longitudinal bore and be variably displaceable between a first position and a second position. In the first position, the valve head may abut the valve seat to seal the aperture. In the second position, the valve head may be displaced from the valve seat to open the aperture. The poppet valve assembly may be biased to be in the first position by the pressurized fuel. The actuation assembly may be coupled with the poppet valve assembly and operate to move the poppet valve assembly between the first position and the second position.

An engine assembly may include an engine structure defining a cylinder and a fuel injector supported by the engine structure and in communication with the cylinder. The fuel injector may include a housing, a poppet valve assembly, and an actuation assembly. The housing may define a longitudinal bore, a high pressure fuel duct in communication with the longitudinal bore and a valve seat including a valve seat surface and an aperture. The valve seat surface may be in communication with the high pressure fuel duct. The aperture may extend through the valve seat surface and be in communication with the longitudinal bore. The high pressure fuel duct may carry pressurized fuel. The poppet valve assembly may include a stem and a valve head. The poppet valve assembly may be disposed within the longitudinal bore and be variably displaceable between a first position and a second position. In the first position, the valve head may abut the valve seat to seal the aperture. In the second position, the valve head may be displaced from the valve seat to open the aperture. The poppet valve assembly may be biased to be in the first position by the pressurized fuel. The actuation assembly may be coupled with the poppet valve assembly and operate to move the poppet valve assembly between the first position and the second position.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

FIG. 5 is a partial section view of a fuel injector that may be utilized with the engine assembly of FIG. 1;

FIG. 6 is a partial section view of the fuel injector of FIG. 5

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
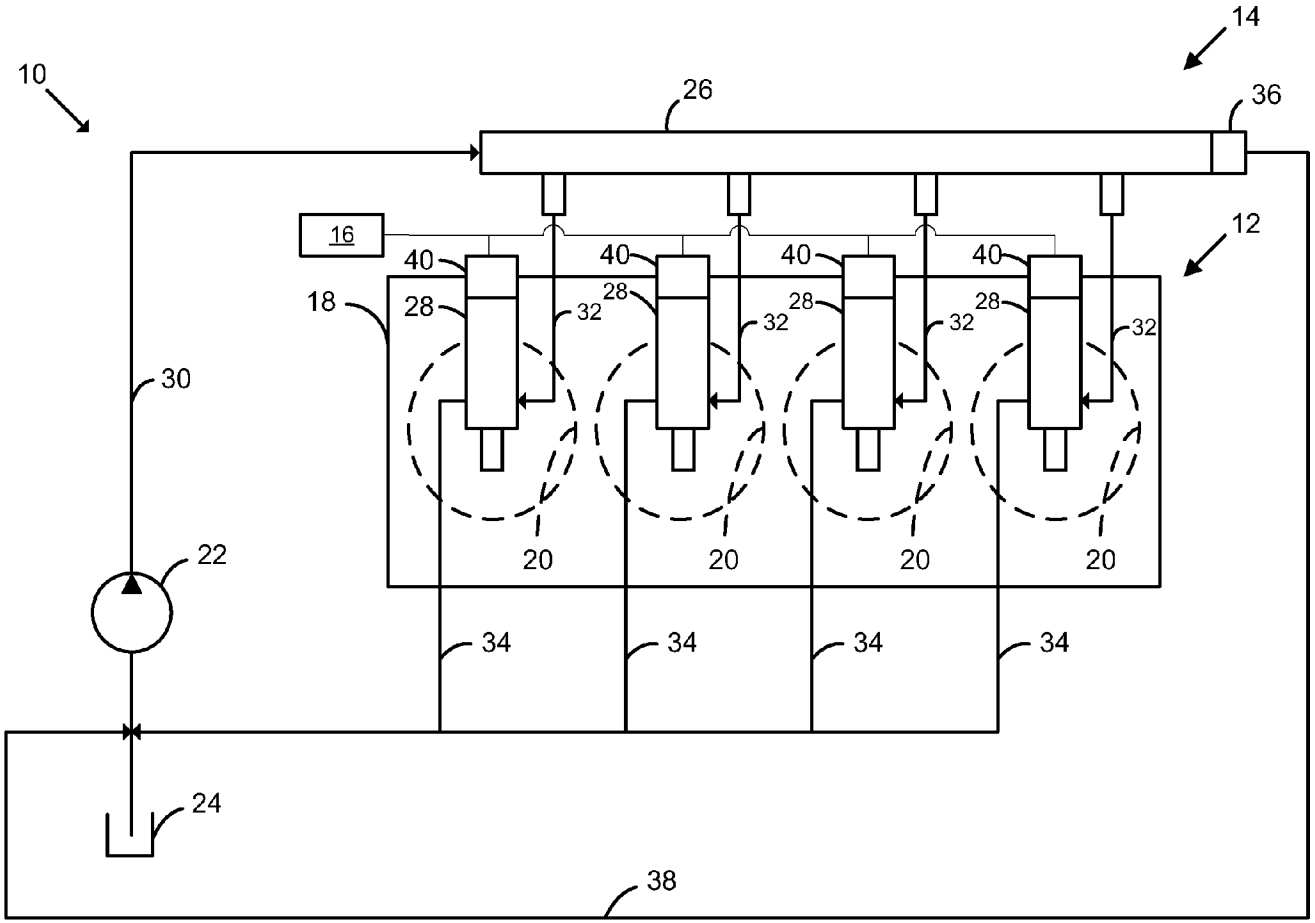
FIG. 1 is a schematic illustration of an engine assembly according to the present disclosure.

Referring to FIG. 1, an exemplary engine assembly 10 is schematically illustrated. The engine assembly 10 may include an engine 12 in communication with a fuel system 14 and a control module 16. In the example shown, the engine 12 may include an engine block 18 that defines a plurality of cylinders 20 in communication with the fuel system 14. While the engine 12 is illustrated as a four cylinder engine in the present disclosure it is understood that the present teachings apply to a variety of engine configurations and is in no way limited to the configuration shown.

The fuel system 14 may include a fuel pump 22, a fuel tank 24, a fuel rail 26, fuel injectors 28, a main fuel supply line 30, secondary fuel supply lines 32 and fuel return lines 34. The fuel pump 22 may be in communication with the fuel tank 24 and may provide a pressurized fuel supply to the fuel rail 26 via the main fuel supply line 30. The fuel rail 26 may provide the pressurized fuel to injectors 28 via the secondary fuel supply lines 32. The fuel rail 26 may include a pressure regulating valve 36 that regulates fuel pressure within the fuel rail 26 by returning excess fuel to the fuel tank 24 via a return line 38.

The fuel injectors 28 may each include an actuation assembly 40 in communication with the control module 16. In the present non-limiting example, the fuel injectors 28 may form direct injection fuel injectors where fuel is injected directly into the cylinders 20. The fuel injectors 28 may return excess fuel to the fuel tank 24 via the fuel return lines 34.

Figure 2:
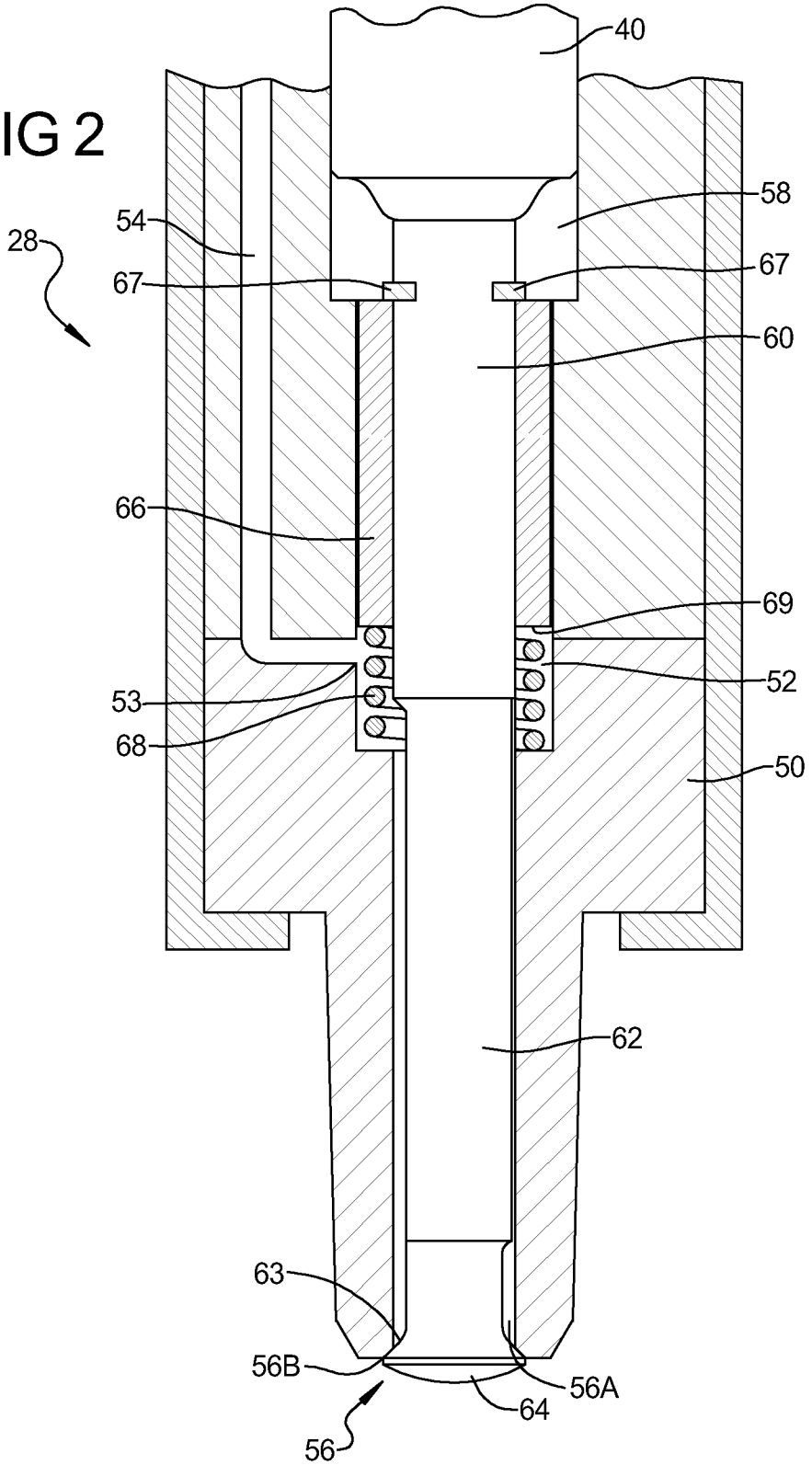
FIG. 2 is a partial section view of a fuel injector of the engine assembly of FIG. 1 in a first position.
Figure 3:
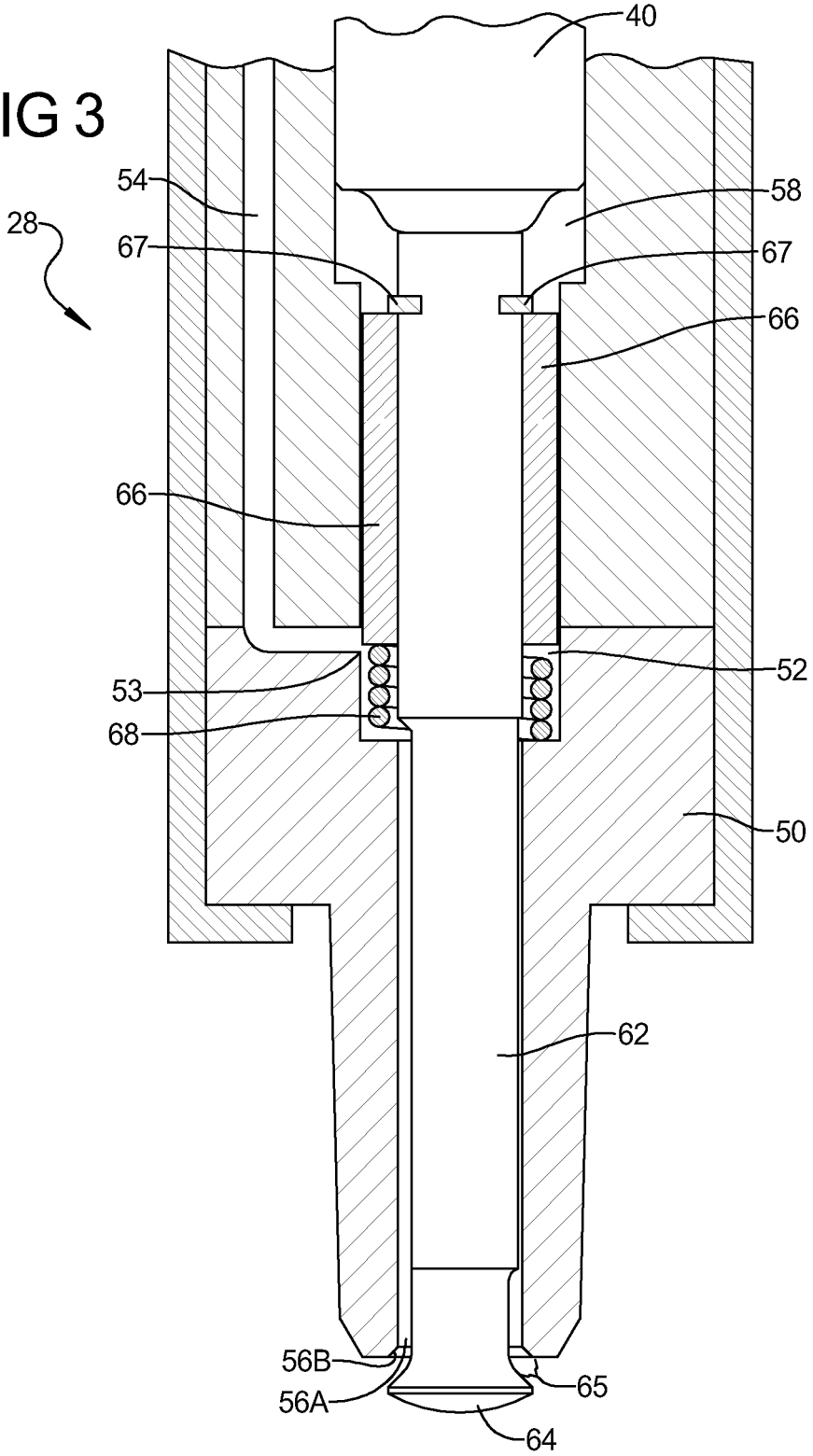
FIG. 3 is a partial section view of a fuel injector of the engine assembly of FIG. 1 in a second position.

Referring to FIGS. 2-3, an exemplary fuel injector 28 according to the present disclosure is illustrated. The fuel injector 28 may include a housing 50. The housing 50 may define a longitudinal bore 52 and a high pressure fuel duct 54. The longitudinal bore 52 may be in communication with the high pressure fuel duct 54 at a fuel inlet port 53. The housing 50 may further define a valve seat 56. The valve seat 56 may include an aperture 56A and a valve seat surface 56B. The valve seat surface 56B may be in communication with the longitudinal bore 52 and high pressure fuel duct 54. The aperture 56A may extend through the valve seat surface 56B and be in communication with the longitudinal bore 52.

Fuel injector 28 may include a poppet valve assembly 60 disposed within the longitudinal bore 52. The poppet valve assembly 60 may include a stem 62 and a valve head 64. In a first position of the poppet valve assembly 60, i.e., the closed position, the valve head 64 may abut the valve seat 56 to seal the aperture 56A. In a second position of the poppet valve assembly 60, i.e., the fully opened position, the valve head 64 may open the aperture 56A to the maximum extent allowed to spray pressurized fuel into the cylinder 20 in which the fuel injector 28 is inserted. The poppet valve assembly 60 may be variably displaceable such that the valve head 64 may be moved to a plurality of positions between the first (closed) position and the second (fully opened) position. In this manner, the poppet valve assembly 60 may vary the size of the valve opening 65, which provides a variable amount of fuel and/or fuel flow rate to the cylinder 20.

Figure 4:
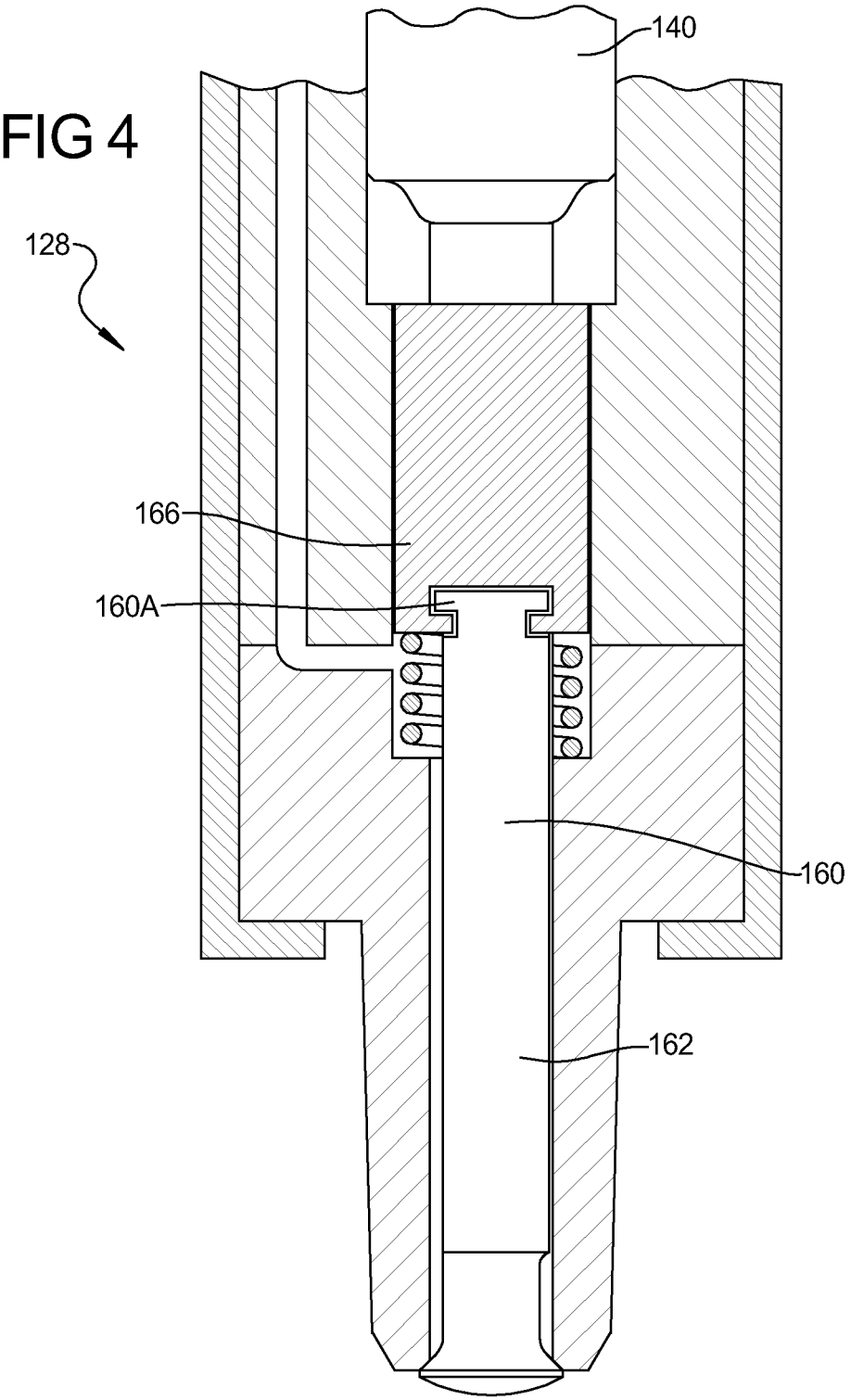
FIG. 4 is a partial section view of a fuel injector that may be utilized with the engine assembly of FIG. 1.
Figure 7:
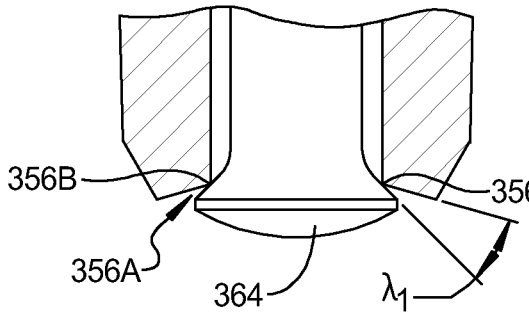
FIG. 7 is a partial section view of a fuel injector that may be utilized with the engine assembly of FIG. 1.
Figure 8:
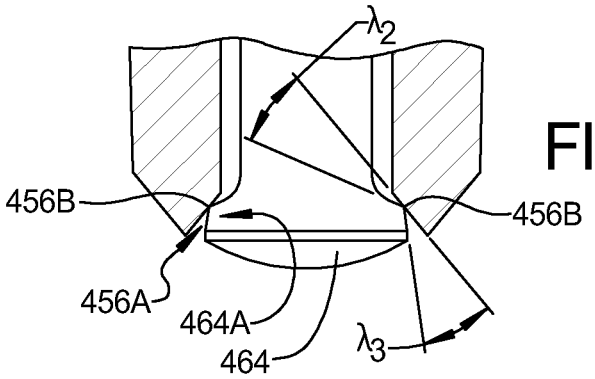
FIG. 8 is a partial section view of a fuel injector that may be utilized with the engine assembly of FIG. 1.
Figure 9:
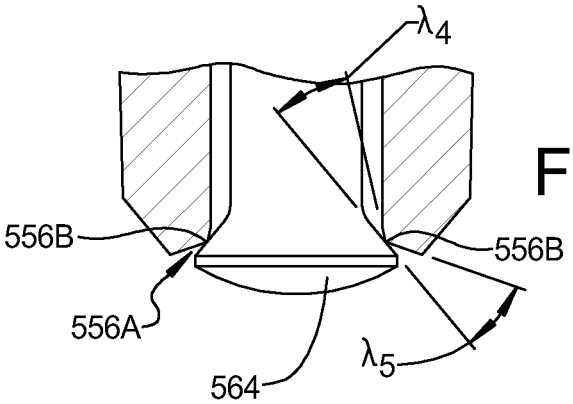
FIG. 9 is a partial section view of a fuel injector that may be utilized with the engine assembly of FIG. 1.
Figure 10:
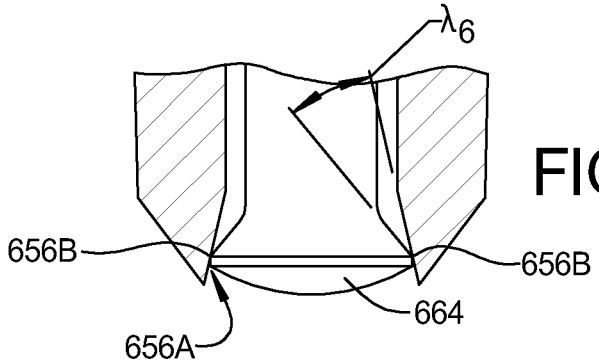
FIG. 10 is a partial section view of a fuel injector that may be utilized with the engine assembly of FIG. 1.

The poppet valve assembly 60 may further include a piston 66 coupled to the stem 62. The piston 66 may be directly coupled to the stem 62 or, alternatively, the piston 66 may be coupled to the stem 62 indirectly, i.e., through the use of an auxiliary component or components. In one non-limiting example, the piston 66 may be coupled to the stem 62 through interaction with projections 67 coupled to the stem 62 (see FIGS. 2-3). A low clearance, interference fit and/or sealant or adhesive between stem 62 and piston 66 may be used in order to inhibit pressurized fuel from flowing between the stem 62 and piston 66. Another non-limiting example is shown in FIG. 4. FIG. 4 illustrates a fuel injector 128 similar to fuel injector 28 with the exceptions noted below. Fuel injector 128 may have a poppet valve assembly 160 that includes a clevis portion 160A on stem 162. The clevis portion 160A may be engaged with piston 166 such that movement of the piston 166, e.g., by actuation assembly 140, may also move stem 162. A biasing member 68 may interact with the stem 62 and/or piston 66 to bias the poppet valve assembly 60, 160 to be in the first (closed) position. The biasing member 68 may be a compression spring or similar device.

Pressurized fuel may be provided to the longitudinal bore 52 of the fuel injector 28 through the high pressure fuel duct 54. The pressurized fuel may bias the poppet valve assembly 60 to be in the first (closed) position. The valve head 64 may define a valve head surface area 63 that contacts the pressurized fuel in the first (closed) position. Similarly, the piston 66 may define a piston surface area 69 that contacts the pressurized fuel. In one exemplary embodiment, the piston surface area 69 is greater than the valve head surface area 63 such that the pressurized fuel biases the poppet valve assembly 60 to be in the first (closed) position. In another exemplary embodiment, the piston surface area 69 is equal to the valve head surface area 63 such that the pressurized fuel in combination with the biasing member 68 biases the poppet valve assembly 60 to be in the first (closed) position. Furthermore, the biasing member 68 may also bias the poppet valve assembly 60 to be in the first (closed) position. The biasing member 68 may thus seal the aperture 56A in a situation where fuel is not being provided at a sufficient pressure to the fuel injector 28 (such as when the engine assembly 10 is off).

The poppet valve assembly 60 may be moved between the first (closed) position and the second (fully opened) position by an actuation assembly 40 coupled thereto. The actuation assembly 40 may be any variable position actuator, for example, a piezoelectric actuator, an electromagnetic actuator, a magnetostrictive actuator, a servo actuator or a solenoid actuator. In a non-limiting example, the actuation assembly 40 is coupled to the stem 62 and operates to move the valve head 64 between the first (closed) position and second (fully opened) position. As discussed above, the actuation assembly 40 may operate to move the poppet valve assembly 60 to a plurality of positions between the first (closed) position and the second (fully opened) position such that the size of the valve opening 65 will vary, thus providing a variable amount of fuel and/or fuel flow rate to the cylinder 20.

The housing 50 may further define a low pressure fuel duct 58. The low pressure fuel duct 58 may be in communication within the longitudinal bore 52. The piston 66 may be disposed between the high pressure fuel duct 54 and the low pressure fuel duct 58. During operation of the fuel injector 28, pressurized fuel may travel around the piston 66 from the high pressure fuel duct 54 to the low pressure fuel duct 58. The clearance between piston 66 and longitudinal bore 52 may be as low as practical (for example, between 0.1 and 5 microns) in order to minimize fuel flow between the high pressure fuel duct 54 to the low pressure fuel duct 58, while still permitting movement of the poppet valve assembly 60 between the first (closed) position and second (fully opened) position. The low pressure fuel duct 58 may be in communication with the fuel return lines 34 such that excess fuel may be returned to the fuel tank 24, as discussed above.

FIGS. 5-6 illustrate an alternative fuel injector 228 according to the present disclosure. The fuel injector 228 may be similar to fuel injectors 28, 128 with the exceptions noted below. The stem 262 of fuel injector 228 may include one or more guide members 261 that assist in maintaining the poppet valve assembly 260 centered within the longitudinal bore 252 of the housing 250. For example, referring to FIG. 6, the stem 262 may have an X-shaped cross-section such that the guide members 261 contact the walls of the longitudinal bore 252. In further non-limiting examples, the guide member 261 may include the stem 262 itself. Fuel flow passages (not shown), for example, spiral or other shaped grooves, may be incorporated on the surface of or within the stem 262 to provide communication between valve seat 256 and high pressure fuel duct 254. Alternatively or in combination with fuel flow passages on/within the stem 262, fuel flow passages (not shown) may be incorporated on the surface of the longitudinal bore 252 or within the housing 250.

Referring to FIGS. 7-10, a plurality of non-limiting examples of valve/valve seat seating configurations is illustrated. The valve/valve seat configurations may be incorporated into any of the fuel injectors 28, 128, 228 discussed above. In a first example (FIG. 7), aperture 356A may be sealed in the first (closed) position by contacting an inner surface of a valve head 364 with a valve seat surface 356B. The angle $\lambda_1$ defined between the valve seat surface 356B and the valve head 364 may be relatively small (for example, 0.5 to 5 degrees) such that the sealing of the aperture 356A is robust and resistant to wear.

In a second example (FIGS. 8-9), aperture 456A, 556A may be sealed in the first (closed) position by contacting a central surface of a valve head 464, 564 with a valve seat surface 456B, 556B. For example, this may be accomplished by utilizing a projection 464A formed on the valve head 464 (FIG. 8) to contact valve seat surface 456B, by utilizing a projection on housing 550 (FIG. 9) as the valve seat surface 556B, or a combination thereof. The angles $\lambda_2$, $\lambda_3$, $\lambda_4$, $\lambda_5$ defined between the valve seat surfaces 456B, 565B and the valve heads 464, 564 may be relatively small (for example, 0.5 to 5 degrees) such that the sealing of the aperture 456A, 556A is robust and resistant to wear.

In a third example (FIG. 10), aperture 656A may be sealed in the first (closed) position by contacting an outer surface of a valve head 664 with a valve seat surface 656B. The angle $\lambda_6$ defined between the valve seat surface 656B and the valve head 664 may be relatively small (for example, 0.5 to 5 degrees) such that the sealing of the aperture 656A is robust and resistant to wear.

What is claimed is:

1. A fuel injector comprising:

a housing defining a longitudinal bore, a high pressure fuel duct in communication with the longitudinal bore and a valve seat including a valve seat surface and an aperture, the valve seat surface being in communication with the high pressure fuel duct and the aperture extending through the valve seat surface and being in communication with the longitudinal bore, wherein the high pressure fuel duct carries pressurized fuel, a low pressure fuel duct disposed at an opposite end of the longitudinal bore from the valve seat and having a larger diameter than the longitudinal bore, the low pressure fuel duct being connected with a fuel return line;

a poppet valve assembly including a stem and a valve head having a larger diameter than the stem and the aperture of the valve seat, the poppet valve assembly being at least partially disposed within the longitudinal bore and being variably displaceable between a first position and a second position, the valve head abutting the valve seat in the first position to seal the aperture, the valve head being displaced from the valve seat in the second position downstream of the valve seat to open the aperture, wherein the poppet valve assembly is biased to be in the first position by the pressurized fuel;

an actuation assembly coupled with the poppet valve assembly that operates to move the poppet valve assembly between the first position and the second position; and a piston formed separately from and coupled to the stem and a biasing member directly engaging an end face of the piston to bias the poppet valve assembly to be in the first position, wherein the end face of the piston defines a first surface area and the valve head defines a second surface area opposite to the end face of the piston to define a passage that communicates directly between the piston and the valve head, the passage interacting with the pressurized fuel, the first surface area being greater than the second surface area such that the poppet valve assembly is biased to be in the first position by the pressurized fuel, the piston being disposed in said longitudinal bore between said high pressure fuel duct and the low pressure fuel duct with a clearance between the piston and the longitudinal bore being between 0.1 and 5 microns.

2. The fuel injector of claim 1, wherein the actuation assembly includes at least one of a piezoelectric actuator, an electromagnetic actuator, a magnetostrictive actuator, a servo actuator and a solenoid actuator.

3. The fuel injector of claim 2, wherein the actuation assembly operates to move the poppet valve assembly to a plurality of positions between the first position and the second position.

4. The fuel injector of claim 3, wherein the stem includes at least one guide member that assists in maintaining the poppet valve assembly centered within the longitudinal bore.

5. The fuel injector of claim 1, wherein the actuation assembly operates to move the poppet valve assembly to a plurality of positions between the first position and the second position.

6. The fuel injector of claim 1, wherein the stem includes at least one guide member that assists in maintaining the poppet valve assembly centered within the longitudinal bore.

7. An engine assembly comprising:

an engine structure defining a cylinder; and a fuel injector supported by the engine structure and in communication with the cylinder, the fuel injector including:

a housing defining a longitudinal bore, a high pressure fuel duct in communication with the longitudinal bore and a valve seat including a valve seat surface and an aperture, the valve seat surface being in communication with the high pressure fuel duct and the aperture extending through the valve seat surface and being in communication with the longitudinal bore, wherein the high pressure fuel duct carries pressurized fuel, a low pressure fuel duct disposed at an opposite end of the longitudinal bore from the valve seat and having a larger diameter than the longitudinal bore, the low pressure fuel duct being connected with a fuel return line;

a poppet valve assembly including a stem and a valve head having a larger diameter than the stem and the aperture of the valve seat, the poppet valve assembly being at least partially disposed within the longitudinal bore and being variably displaceable between a first position and a second position, the valve head abutting the valve seat in the first position to seal the aperture, the valve head being displaced from the valve seat in the second position downstream of the valve seat to open the aperture, wherein the poppet valve assembly is biased to be in the first position by the pressurized fuel;

an actuation assembly coupled with the poppet valve assembly that operates to move the poppet valve assembly between the first position and the second position; and a piston formed separate from and coupled to the stem and a biasing member directly engaging an end face of the piston to bias the poppet valve assembly to be in the first position, wherein the end face of the piston defines a first surface area and the valve head defines a second surface area opposite to the end face of the piston to define a passage that communicates directly between the piston and the valve head, the passage interacting with the pressurized fuel, the first surface area being greater than the second surface area such that the poppet valve assembly is biased to be in the first position by the pressurized fuel, the piston being disposed in said longitudinal bore between said high pressure fuel duct and the low pressure fuel duct with a clearance between the piston and the longitudinal bore being between 0.1 and 5 microns.

8. The engine assembly of claim 7, wherein the actuation assembly includes at least one of a piezoelectric actuator, an electromagnetic actuator, a magnetostrictive actuator, a servo actuator and a solenoid actuator.

9. The engine assembly of claim 8, wherein the actuation assembly operates to move the poppet valve assembly to a plurality of positions between the first position and the second position.

10. The engine assembly of claim 9, wherein the stem includes at least one guide member that assists in maintaining the poppet valve assembly centered within the longitudinal bore.

11. The engine assembly of claim 7, wherein the actuation assembly operates to move the poppet valve assembly to a plurality of positions between the first position and the second position.

12. The engine assembly of claim 7, wherein the stem includes at least one guide member that assists in maintaining the poppet valve assembly centered within the longitudinal bore.

13. The fuel injector of claim 1, wherein the valve seat surface is in communication with the high pressure fuel duct and the aperture extending through the valve seat surface via the longitudinal bore.

14. The engine assembly of claim 7, wherein the valve seat surface is in communication with the high pressure fuel duct and the aperture extending through the valve seat surface via the longitudinal bore.

* * * * *